US005233317A

United States Patent [19]

Snodgrass et al.

[11] Patent Number: 5,233,317

[45] Date of Patent: Aug. 3, 1993

[54] DISCRETE STEP MICROWAVE ATTENUATOR

[75] Inventors: Kirk A. Snodgrass; Peter D. Bailey, both of Phoenix, Ariz.

[73] Assignee: Honeywell Inc., Minneapolis, Minn.

[21] Appl. No.: 770,690

[22] Filed: Oct. 3, 1991

[51] Int. Cl.[5] ..... H01P 1/22

[52] U.S. Cl. ..... 333/81 A; 333/116

[58] Field of Search ..... 333/109, 115, 116, 81 R, 333/81 A

[56] References Cited

U.S. PATENT DOCUMENTS 4,517,535 5/1985 Pon ..... 333/81 A 4,559,489 12/1985 Vacanti et al. ..... 333/116 X

FOREIGN PATENT DOCUMENTS 54402 3/1982 Japan ..... 333/81 A

*Primary Examiner*—Paul Gensler

*Attorney, Agent, or Firm*—Seymour Levine; Dale E. Jepsen; Donald J. Lenkszus

[57] ABSTRACT

A step attenuator comprises two branchline couplers with two coupling transmission lines therebetween. Attenuation is accomplished through switchable resistors, in series with switching diodes, shunted across the transmission lines. These resistors reflect and absorb incident power. Switching signals are provided to the diodes through the branchline couplers and the coupling transmission lines. The reflected power is absorbed by a matched termination at the port of the input branchline coupler that is isolated from the port at which the signal to be attenuated is coupled. Phase shift and insertion loss are minimized by tuning the series inductance inherent in the diode resistor combination with tuning capacitors in series therewith. These capacitors are by passed by low-susceptance inductors which provide a dc path to ground for the diodes.

3 Claims, 4 Drawing Sheets

DISCRETE STEP MICROWAVE ATTENUATOR

BACKGROUND OF THE INVENTION

1. Field of the Invention

The invention pertains to the field of microwave attenuators and more particularly to matched microwave variable attenuation in monolithic microwave integrated circuits.

2. Description of the Prior Art

Microwave attenuators of the prior art provide attenuation in either discrete step attenuation or continuously variable. The continuously variable attenuators have one of two classic configurations; the resistive Pi circuit and the resistive T circuit. These attenuators utilize either PIN diodes or field effect transistors (FETs) for the series and shunt resistors. PIN diodes and FETs exhibit resistive changes with properly applied DC voltages and thus are useful as variable resistors. The resistive values of these Pi and T circuits for all levels of attenuation are chosen to provide an impedance that matches the impedance of a transmission line, or another microwave device, to suppress reflections in the system. To accomplish this, the ratio of the shunt and series resistors must change with attenuation changes, establishing a functional relationship of the ratio versus attenuation which is extremely non-linear. This presents a very difficult tracking problem, requiring that the dc characteristics of the PIN diodes or FETs utilized in the attenuators be matched over the entire attenuation range. As a result, the PIN diodes and FETs are generally controlled with separate power supplies. Though control circuitry can be provided to supply the DC voltages to the voltage controlled resistances in their proper functional relationship from a single power supply, such circuitry requires much more real estate than the attenuator it controls and is therefore rejected for most applications.

The problem of providing the proper ratios to maintain a constant characteristic impedance for the Pi and T circuits is exacerbated by the non-uniformity of the PIN diode and the FET characteristics that result with present day manufacturing processes. For example, the equivalent resistance value of a FET is a function of the pinch-off voltage, that voltage which must be exceeded by the gate voltage for current to flow in the FET. Present day manufacturing processes, however, yield FETs with pinch-off voltages that vary substantially. Since the resistance of the FET is a function of the pinch-off voltage, FETs exhibit resistance values having varying functional relationships of the gate voltage. Thus, for each attenuator a process is encountered for selecting three FETs with equal resistance versus gate voltage characteristics, greatly increasing cost of the attenuators.

Further, resistive Pi and T circuits cannot simultaneously realize low (off) state insertion loss and a large dynamic attenuation range with the variable resistors presently available. For both circuits a low insertion loss requires a low resistance value for the series elements and a high resistance value for the shunt elements. As attenuation increases from the minimum value the series resistance increases, while the shunt resistance decreases. Since the shunt resistances start at opposite ends of the functionality curve it is extremely difficult to provide the ratio of series resistance to shunt resistance required for the attenuation values desired and simultaneously maintain a constant characteristic impedance for the circuits.

Additionally, at high frequencies, the internal capacitances of the PIN diodes and FETs establish complex characteristics for the Pi and T circuits. To provide real characteristic impedances it is necessary to resonate these capacitances by shunting inductors across the elements of the Pi and T circuits. These resonant circuits severely limit the operating bandwidth of the attenuator.

An attenuator which provides improved performance over the Pi and T circuits is disclosed in U.S. Pat. No. 4,970,478 issued to the assignee of the present invention. This patent discloses a variable microwave attenuator which includes a plurality of ladder circuits (cells) each having a series inductance and a shunt circuit comprising a capacitor and a variable resistor in parallel. The cells are cascaded in a manner to establish an artificial transmission line with distributed loss provided by the variable resistor shunt elements. These variable resistor shunt elements may be realized by utilizing FETs which exhibit resistive changes of voltage applied to their gates. The series inductance, shunt capacitance, and shunt variable resistors are chosen to establish an impedance for the artificial line that is substantially independent of the shunt resistance value and to provide a low reflection coefficient with its concomitant low voltage standing wave ratio (VSWR). When cascaded, the internal ladder sections combine to form lossless symmetrical Pi cells with a variable resistor positioned between each cell. Symmetry of the artificial line may be completed with the addition of a shunt capacitor at one end of the artificial line to establish lossless symmetrical Pi end sections for the transmission that are identical to the internal lossless symmetrical Pi sections formed by cascading the ladder networks.

Though the artificial line of U.S. Pat. No. 4,970,478 provides variable attenuation by the adjustment of but one resistance value per cell and may provide a characteristic impedance which is independent of the shunt resistance value, such performance is difficult to achieve. Further, due to the resistance variation of PIN and FETs, previously described, a variable attenuator which provides attenuation with reasonable precision requires extensive calibration, adding appreciable cost to the device.

Another prior art attenuator which minimizes the problem of maintaining the characteristic impedance with attenuation variations is disclosed in U.S. Pat. No. 5,109,204 entitled "High Power RF Precision Attenuator" issued to Lyndon M. Keefer on Apr. 28, 1992 and assigned to the assignee of the present invention. This patent discloses a variable microwave attenuator utilizing a first pair of isolated quadrature hybrid ports as the input and output ports of the attenuator and providing the second pair of isolated ports with switchably coupled resistive terminations, the resistance at each termination being equal and selected in accordance with the attenuation desired. Since these resistors are not matched to the hybrid's characteristic impedance the portion of the signals incident to the terminated ports, that are not dissipated in the resistive termination, are reflected and coupled in the hybrid in a manner to be out-of-phase at the input port, thus cancelling thereat, and to be in-phase at the output port, thus adding thereat to provide the attenuated output signal. A throughput without attenuation is provide by shunting diodes across the terminating resistors. When these diodes are in the conducting state, short circuits are established which reflect the entire signal to the output port. This arrangement is wasteful of energy, requiring dc power whether or not the device is attenuating microwave signals. Further, conducting diodes do not provide complete short circuits. Thus some attenuation is realized in the throughput state.

Another variable attenuator of the prior art provides attenuation by switchably coupling resistors of equal value across the two output ports of a quadrature hybrid circuit, the output ports are then coupled to the input ports of a second quadrature hybrid. One input port of the first hybrid and one output of the second hybrid are terminated with a resistor having a resistance equal to the characteristic impedance of the hybrid to absorb power coupled to these ports. The remaining input port of the first hybrid and the remaining output port of the second hybrid serve as the input and output ports of the attenuator, respectively. Attenuation control is accomplished with switching diodes in series with the attenuator resistors. Each of these diodes are independently controlled through respective driver circuits directly connected to the associated diode. The attenuator therefore requires an appreciable number of circuit elements for the driver assembly and appreciable switching power to effectuate an attenuation change.

SUMMARY OF THE INVENTION

In accordance with the principles of the present invention, a programmable variable microwave attenuator includes first and second printed branchline couplers (quadrature hybrid couplers) constructed on a common substrate. An output set of isolated ports of the first branchline coupler is coupled to an input set of isolated ports of the second branchline coupler. One of the isolated input ports of the first coupler is terminated with a matched impedance while the second input port serves as the RF input to the device. In like manner one output port of the second coupler is matched terminated while the other serves as the output port of the attenuator. Shunt resistors, which determine the attenuation of the device, are coupled at the junction of the two branch lines through switching diodes. Switching is accomplished by a single driver circuit coupled to all the switching diodes via the branchline coupler. This driver establishes three diode states; all diodes off, two (2) diodes forward biased, and alterante pair of diodes forward biased. Each of these diode states provides a respective attenuation value. The all diodes off state permits a signal to pass through the device unattenuated while the other two states are associated with respective attenuations. RF phase shift and insertion loss are minimized by positioning appropriate capacitors in series with each resistor-diode combination to tune the inductance associated with these combinations. These tuning capacitors are by passed with low susceptance shunt inductors to permit the flow of dc current from the driver to the diodes.

The aspects and advantages of the invention will be understood more fully from the following description of the preferred embodiment thereof, which is by way of example only, with reference to the accompanying drawings.

DESCRIPTION OF THE PREFERRED EMBODIMENTS

Figure 1:
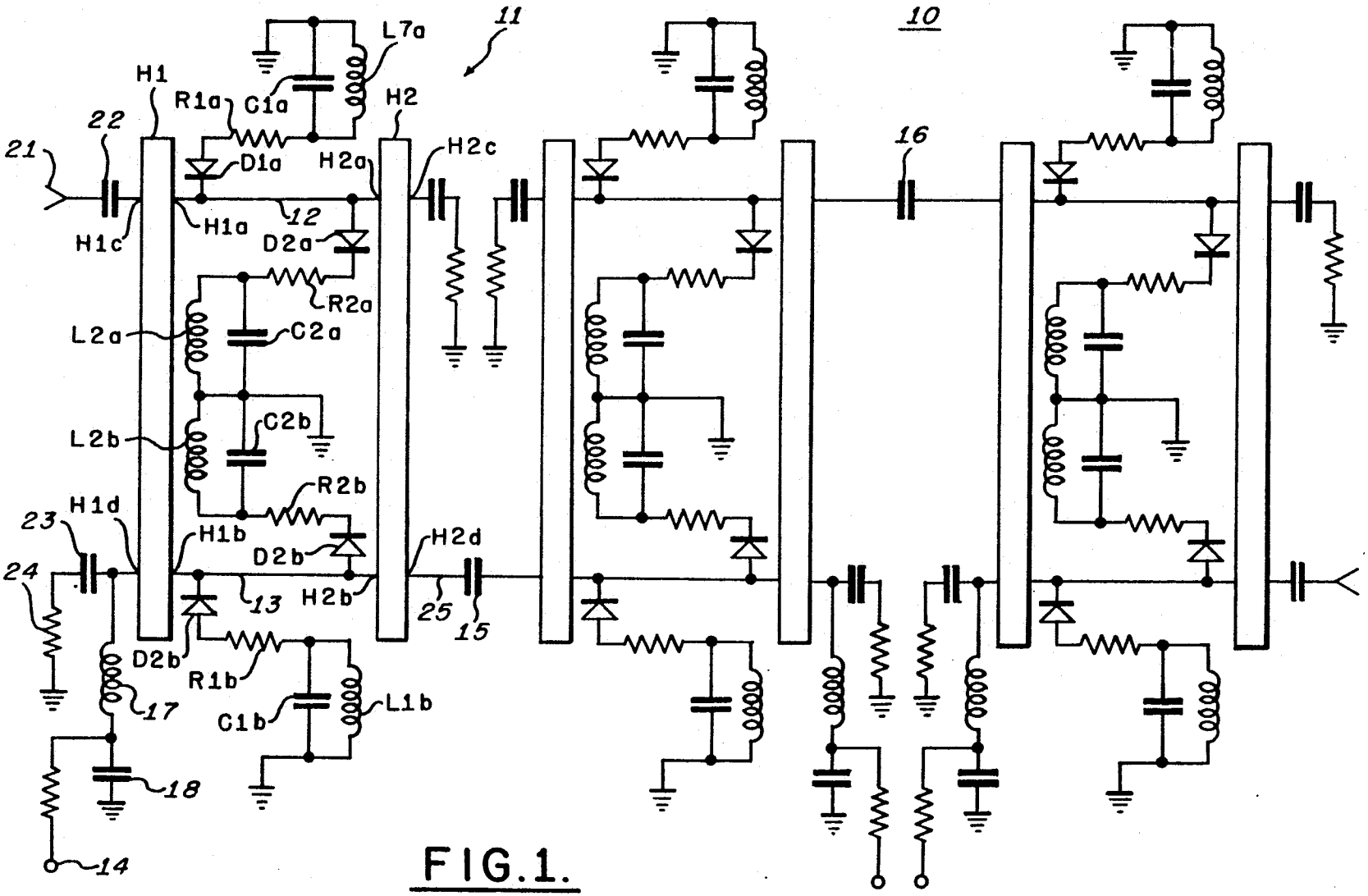
FIG. 1 is a schematic diagram of a preferred embodiment of the invention.

A digital programmable attenuator, generally designated 10, using three stages of the invention, each providing digitally selectable attenuations, is shown schematically in FIG. 1. The three stages are substantially identical, differing only in the value of the resistors positioned between the branch line couplers (3 dB quadrature hybrids) which determine the attenuation values of the attenuation stage. Therefore, the invention will be explained with reference to the input stage 11.

In accordance with the invention, the output ports H1*a* and H1*b* of a first 3 dB quadrature hybrid H1 are respectively coupled to input ports H2*a* and H2*b* of a second 3 dB quadrature hybrid H2 via transmission lines 12 and 13. Shunted across the transmission line 12 are resistors R1*a* and R2*a* which are selectable through PIN diodes D1*a* and D2*a*, respectively. Capacitors C1*a* and C2*a* are also positioned in series with the resistor-diode combinations R1*a*-D1*a* and R2*a*-D2*a*, respectively, to tune out the inductive reactance inherent in resistors and diodes at radio frequencies. The series resistor-diode-capacitor circuit minimizes the phase shift and excess insertion loss, due to unwanted reflections, but does not provide a dc path to ground for the diode bias. This dc path is established by low susceptance inductors L1*a* and L1*b* coupled in parallel with the capacitors C1*a* and C2*a*, respectively. The inductance value of the inductors L1*a* and L2*a* is chosen to provide a resonance with the capacitors C1*a* and C2*a* that is well outside of the frequency band of interest while providing an effective rf choke and dc short circuit. Similarly, shunted across transmission line 13 are resistors R1*b* and R2*b*, diodes D1*b* and D2*b*, inductors L1*b* and L2*b*, and capacitors C1*b* and C2*b*. The elements shunted across transmission line 13 are arranged in the same configuration and are of the same value as their counter parts shunted across the transmission line 12.

The branch line couplers H1 and H2 are constructed as microstrip circuits in manner to provide a continuous dc path from a control terminal 14 to the four diodes D1*a*, D1*b*, D2*a*, and D2*b*. Capacitors 15 and 16 are coupled between attenuator stages to block the dc control signals of one stage from affecting the shunt resistor selection of another stage of the attenuator.

The diodes D1*a* and D1*b* have the same polarity as do the diodes D2*a* and D2*b*. The polarities of diodes D1*a* and D2*a* are opposite, as are the polarities of diodes D1*b* and D2*b*. Thus, for example, diodes D1*a* and D1*b* conduct, shunting resistors R1*a* and R1*b* across transmission lines 12 and 13, respectively, and diodes D2*a* and D2*b* are cut-off when a voltage −V is applied to the control terminal 14. Conversely, diodes D1*a* and D1*b* are cut-off and diodes D2*a* and D2*b* conduct, shunting resistors R2*a* and R2*b* across transmission lines 12 and 13, respectively, when a voltage +V is applied to control terminal 14. When zero (0) voltage is at control terminal 14 all diodes are cut-off, thus eliminating all shunt resistors across the transmission lines 12 and 13. Consequently, three resistive values may be shunted across each transmission line; O, (R1*a*,R1*b*), and (R2*a*,R2*b*). Inductance 17 and capacitor 18 are choke and by-pass elements, respectively, which isolate the dc control terminal from the rf signals applied to the attenuator circuit.

Figure 2:
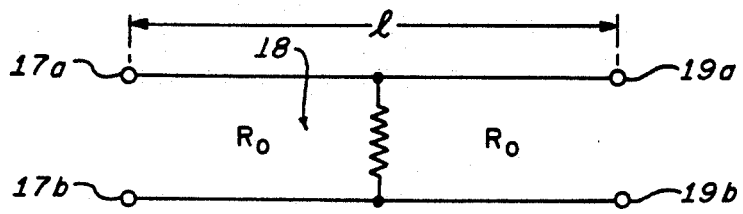
FIG. 2 is a schematic diagram of a resistor shunted transmission line.

A transmission line of characteristic impedence $R_o$ shunted by a resistor R is shown schematically in FIG. 2. A signal having a voltage $V_{inc}$ at the input port 17*a*,17*b* provides an input power $P_{inc}$ equal to $(V_{inc})^2/R_o$ to the transmission line 18. This power is split into three components by the shunt resistor R: $P_d$ equal to $4RR_oP_{inc}/(2R+R_o)^2$ representative of the power dissipated in the resistor R; $P_{ref}$ equal to $4R_o2P_{inc}/(2R+R_o)^2$ representative of the power reflected due to the coupling of the resistor R across the transmission line 18; and $P_t$ equal to $4R^2P_{inc}/(2R+R_o)^2$ representative of the power transmitted to the output port 19*a*,19*b*. Thus the resistance shunted transmission line provides an insertion loss $IL=P_t/P_{inc}=4R^2/(2R+R_o)^2$. This insertion loss, however, is due to reflection caused by the insertion of the resistor and dissipation in the resistor. In addition to the insertion loss, a phase shift, dependent upon the length of the transmission 18, exists between the input port 17*a*,17*b* and the output port 19*a*,19*b*. This phase shift is unchanged when the purely resistive shunt impedance is switchably removed from across the transmission line 18. The shunted transmission line shown in FIG. 2 is not a true attenuator. A true attenuator has only dissipative loss.

A phase shift, dependent upon the length l of the transmission line 18 and the reactance of the shunting impedance, exists between the input port 17*a*,17*b* and the output port 19*a*, 19*b*. This phase shift maybe eliminated when the shunt impedance is purely resistive by providing a length l that is an integer multiple of the signal wavelength.

Positioning two resistance shunted transmission lines between two 3dB quadrature hybrids as shown in stage 11 and other stages of FIG. 1 establishes a true attenuator between the defined input and output ports of each stage and the overall attenuator. Assume a signal of voltage $V_{inc}$ is incident to input port 21 and coupled through dc blocking capacitor 22 to port H1*c* of branch line coupler H1. This signal is split by the hybrid to couple a signal to the port H1*a* which is equal $V_{inc}/\sqrt{2}$ and a signal to the port H1*b* which is equal to $jV_{inc}/\sqrt{2}$. The signals at the ports H1*a* and H1*b* are respectively coupled to transmission lines 12 and 13 wherefrom signals equal to $\Gamma V_{inc}/\sqrt{2}$ and $j\Gamma V_{inc}/\sqrt{2}$ are respectively reflected back to ports H1*a* and H1*b*. Those skilled in the art should recognize that $\Gamma$ is equal $-R_0/(2R+R_0)$. The reflected signal at port H1*a* is split to provide a signal at port H1*c* which is equal to $\Gamma V_{inc}/2$ and a signal which is equal $jV_{inc}/2$ at a fourth port H1*d* of quadrature hybrid H1. Similarly, the reflected signal at the port H1*b* is split to provide a signal at port H1*c* which is equal to $-\Gamma V_{inc}/2$ and a signal at port H1*d* which is equal to $j\Gamma V_{inc}/2$. Consequently, the reflected signals at the input port H1*c* cancel so that no reflected signal exists thereat and the signals at port H1*d* add to establish a signal that is equal to $j\Gamma V_{inc}$. This reflected signal is coupled through a dc blocking capacitor 23 to a matched termination 24 wherein the reflected signal is absorbed. For simplicity of presentation the signal phase shift due to the propagation path length has been neglected. In accordance with the invention the path lengths to the shunt circuits on the transmission lines 12 and 13 are equal. Thus, equal phase terms will be added to all the signals and the basic results are not altered.

As stated above the capacitors C1*a*, C2*a*, C1*b*, and C2*b*, are selected to tune out the inductance inherent in the resistor-diode combinations respectively in series with the capacitors. Assume that the bias voltage at the control terminal 14 is $-V$ so that the equal resistors R1*a* and R1*b* are selected as the shunt resistors on the lines 12 and 13, respectively. In view of the above, the voltage across the shunt resistor R1*a*, which those skilled in the art will recognize to be $(1+\Gamma)V_{inc}/\sqrt{2}$, is coupled to port H2*a* of branch line hybrid H1 and is split to couple signals having voltages equal to $(1+\Gamma)V_{inc}/2$ and $j(1+\Gamma)V_{inc}/2$ to ports H2*c* and H2*d*, respectively. Similarly, the voltage $j(1+\Gamma)V_{inc}/\sqrt{2}$ across the resistor R1*b* is coupled to port H2*b* and split to couple signals having voltages equal to $-(1+\Gamma)V_{inc}/2$ and $j(1+\Gamma)V_{inc}/2$ to ports H2*c* and H2*d*, respectively. From the above it is evident that the signals at port H2*c* cancel and that the signal at port h2*d* has a voltage that is equal to $j(1+\Gamma)V_{inc}$. This signal is coupled from the port H2*d* to a transmission line 25 of characteristic impedance $R_0$ at a power level that is equal to Pinc $(2R1a)^2/(2R1a+R_0)^2$, thereby establishing an attenuator which provides an attenuation equal to the insertion loss of one of the transmission lines, with shunt resistances (R1*a*,R1*b*), coupled between the branch line couplers H1 and H2.

Figure 3A:
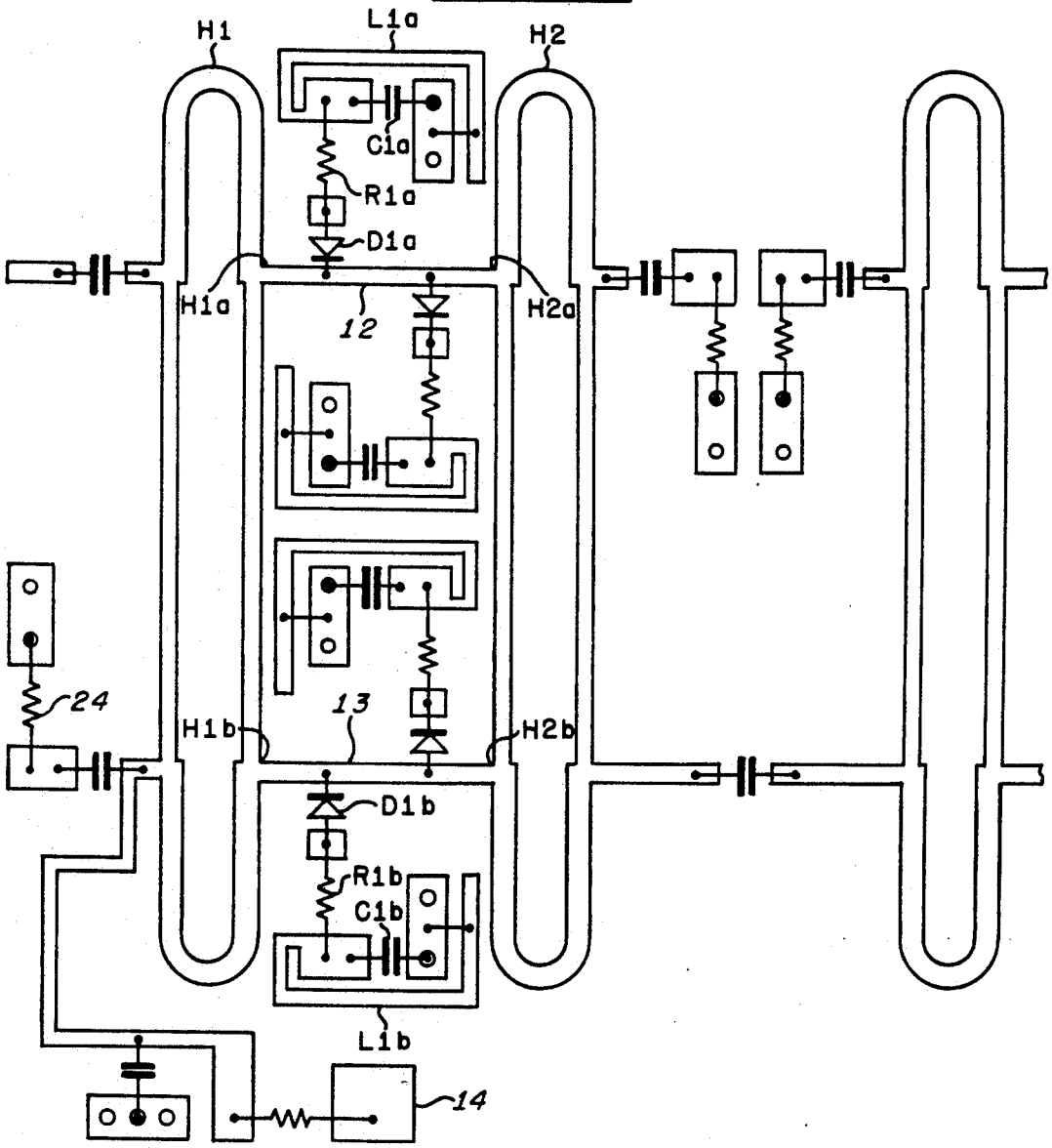
FIGS. 3A-3C are a microstrip configuration of the embodiment of the invention represented by the schematic diagram of FIG. 1.
Figure 3B:
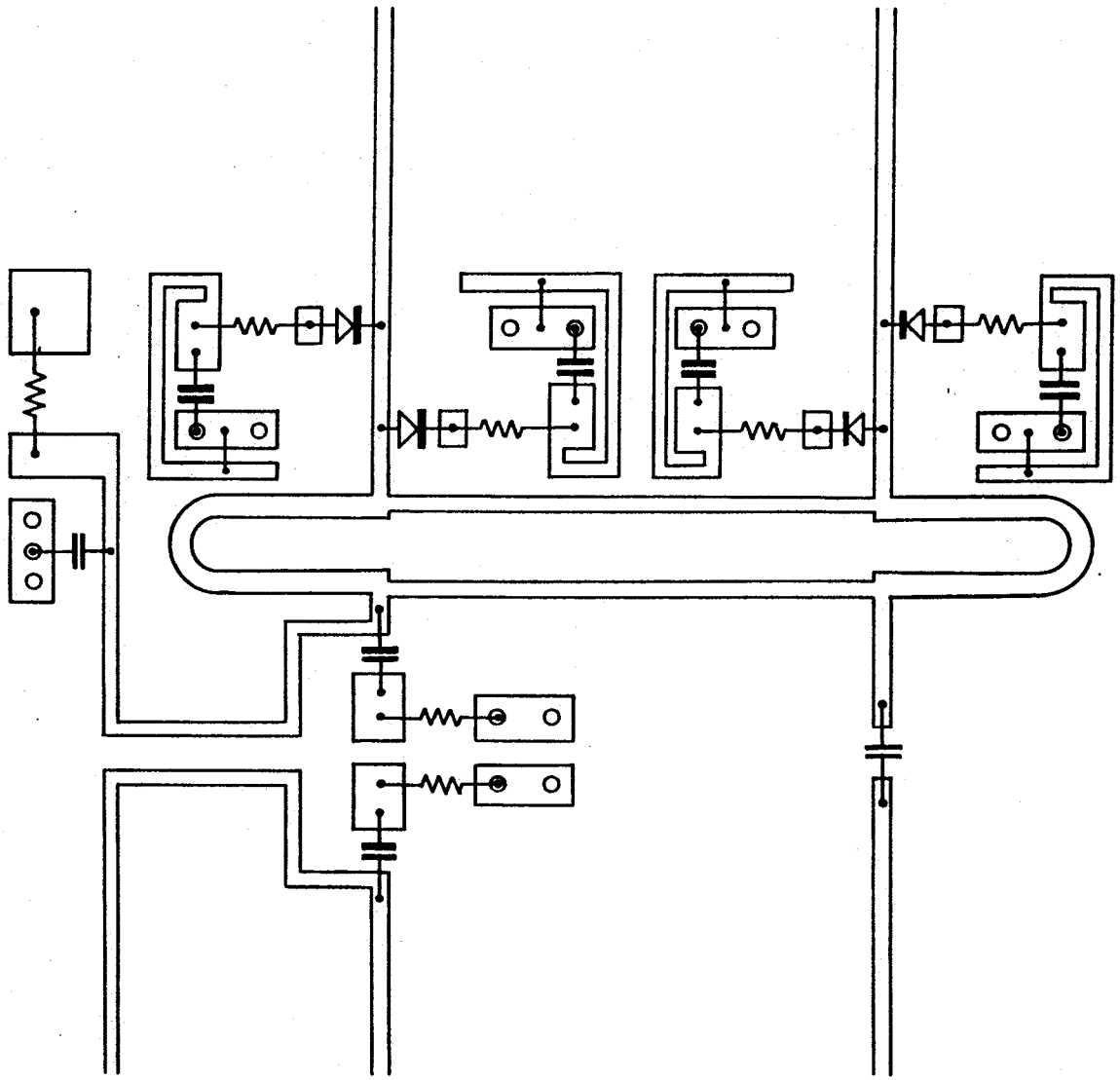
Figure 3C:
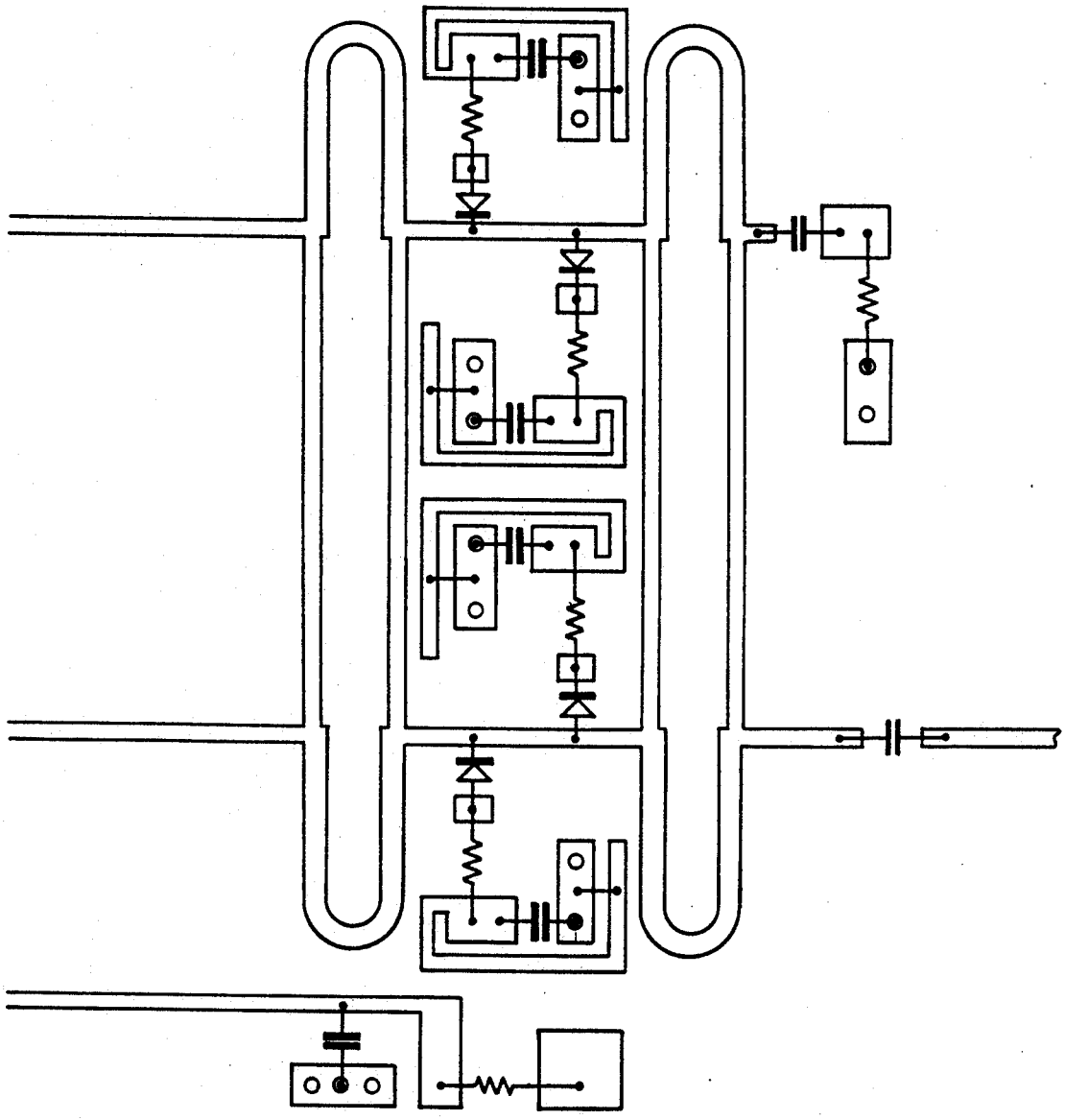

A microstrip configuration for the schematic diagram of FIG. 1 is shown in FIGS. 3A–3C, wherein reference numerals previously assigned indicate corresponding elements in the two figures. For purposes of clarity only a selected number of elements have been referenced. All other elements may be readily identified with the aid of the reference numerals provided. It is apparent from FIGS. 3A–3C that a dc voltage at the control terminal 14 is coupled through the microstrip circuity to bias the diodes as previously explained.

While the invention has been described in its preferred embodiments, it is to be understood that the words which have been used are words of description rather than of limitation and that changes within the purview of the appended claims may be made without departure from the true scope and spirit of the invention in its broader aspects.

We claim:

1. An apparatus for attenuating radio frequency signals comprising:

a first quadrature hybrid circuit constructed in a manner to provide a continuous direct current (dc) path between ports thereof;

a second quadrature hybrid;

first and second transmission lines coupled between said first and second quadrature hybrid circuits in a manner to provide a continuous dc path between said transmission lines and ports of said first quadrature hybrid circuit;

means coupled to one port of said first quadrature hybrid circuit for providing a dc control voltage; and first and second resistor means, each having a plurality of selectable resistors, coupled to said first and second transmission lines, respectively, and responsive to said control voltage for selectively providing one of said plurality of resistors as a shunt resistor across said first and second transmission lines.

2. An apparatus in accordance with claim 1 wherein said first and second resistor means each include:

first and second resistors coupled to one of said first and second transmission lines;

first and second switches responsive to said control voltage and serially coupled with said first and second resistors, respectively, to said one transmission line;

first and second capacitors serially coupled with said first and second resistors and said first and second switches, respectively; and first and second inductances coupled in parallel with said first and second capacitors, respectively.

3. An apparatus in accordance with claim 2 wherein said switches are diodes.

* * * * *